US005791633A

United States Patent [19]

Walker

[11] Patent Number: 5,791,633

[45] Date of Patent: Aug. 11, 1998

[54] SKID PLATE/WINCH MOUNT

[76] Inventor: Donald L. Walker, 6418 Heather Wood Dr., Riverside, Calif. 92509

[21] Appl. No.: 814,407

[22] Filed: Mar. 11, 1997

[51] Int. Cl.[6] ..... B66D 1/00

[52] U.S. Cl. ..... 254/323; 293/117

[58] Field of Search ..... 254/323, 325, 254/326, 327, 328; 293/117, 106; 242/403

[56] References Cited

U.S. PATENT DOCUMENTS

| | | | |
|---|---|---|---|
| 3,606,385 | 9/1971 | Johannes | 293/106 |
| 4,735,448 | 4/1988 | Hart | 254/323 |
| 4,950,010 | 8/1990 | Denny | 293/117 |
| 5,364,142 | 11/1994 | Coiner | 293/106 |
| 5,522,582 | 6/1996 | Dilks | 254/323 |

*Primary Examiner*—Katherine Matecki

[57] ABSTRACT

The skid plate/winch mount allows a vehicle to be equipped with a winch that is readily available for use, and it eliminates many of the problems normally associated with having a vehicle mounted winch. By concealing the winch behind the front bumper and above the skid plate the winch is kept out of the weather, and it is much less susceptible to damage by rocks and other road hazards. This location also aids in theft prevention by keeping the winch out of view. The winch mount also acts as a skid plate, protecting the front underside of the vehicle. The license adapter plate and adapter plate receiver make the winch readily available for use without the need for accessory tools.

20 Claims, 2 Drawing Sheets

SKID PLATE/WINCH MOUNT

TECHNICAL FIELD OF THE INVENTION

This invention relates to winch mounts for mounting a winch to a vehicle, and more particularly to a skid plate/winch mount which conceals the winch behind the vehicle bumper and also acts as a skid plate.

BACKGROUND OF THE INVENTION

Electrically powered winches are often mounted on vehicles, typically in an exposed position adjacent a front bumper.

It would be advantageous to provide an apparatus providing a secure location to a vehicle winch which is hidden from view and protects the front underside of the vehicle from damage by rocks or other road hazards.

It would further be advantageous to provide an apparatus for mounting a vehicle winch which prevents damage to the vehicle by the winch cable, and protects the winch from weather and damage.

SUMMARY OF THE INVENTION

The skid plate/winch mount allows a vehicle to be equipped with a winch that is readily available for use, and it eliminates many of the problems normally associated with having a vehicle mounted winch. By concealing the winch behind the front bumper and above the skid plate the winch is kept out of the weather, and it is much less susceptible to damage by rocks and other road hazards. This location also aids in theft prevention by keeping the winch out of view. The winch mount also acts as a skid plate, protecting the front underside of the vehicle. The license adapter plate and adapter plate receiver make the winch readily available for use without the need for accessory tools.

BRIEF DESCRIPTION OF THE DRAWING

These and other features and advantages of the present invention will become more apparent from the following detailed description of an exemplary embodiment thereof, as illustrated in the accompanying drawings, in which.

DETAILED DESCRIPTION OF THE PREFERRED EMBODIMENT

Figure 1:
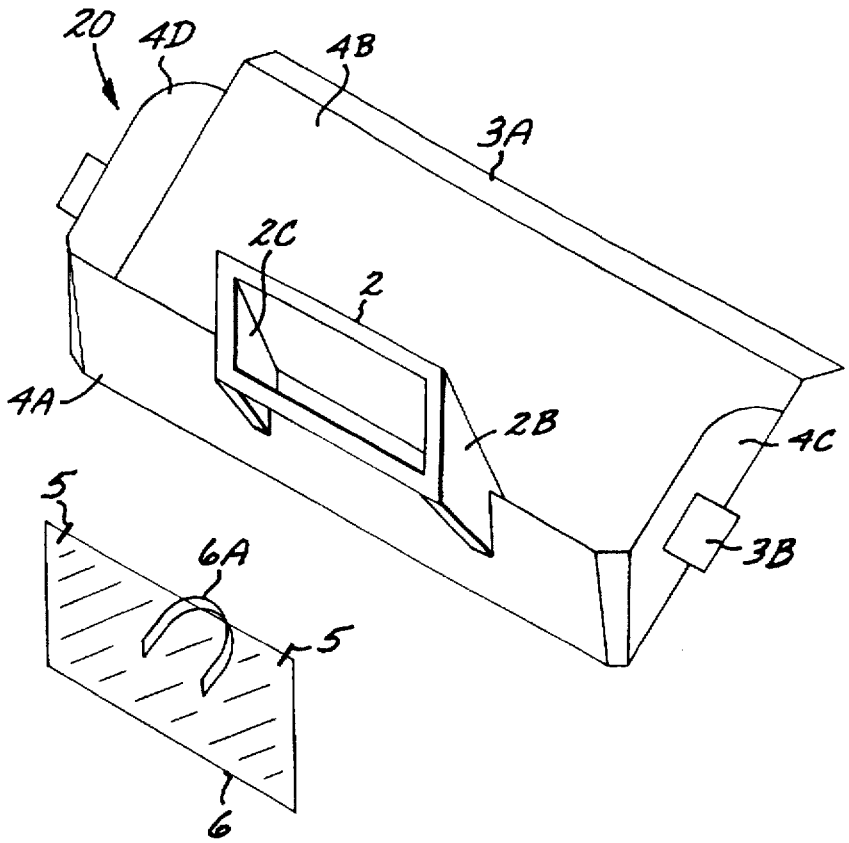
FIG. 1 is an isometric view of a skid plate/winch mount apparatus in accordance with the invention.

The skid plate/winch mount 20 shown in FIG. 1 is viewed from the upper, front, right corner of the mount as it would be installed in the vehicle, with the drawing scale of ⅛" to 1". The skid plate/winch mount 20 includes a main body structure 4 having a plurality of mounting points 3 for fastening the structure 20 to the vehicle frame. The main body 4 defines a winch mounting location 1. The structure 20 further includes an adapter plate receiver/cable guide 2 for receiving an adapter plate 6 when the winch is not in use.

The adapter plate 6 is flush with the outside of the front bumper when the winch is not in use. The license adapter plate receiver cable guide 2 is positioned directly behind the adapter plate. The vehicles front license plate 24 is fastened directly to the adapter plate 6.

Figure 2:
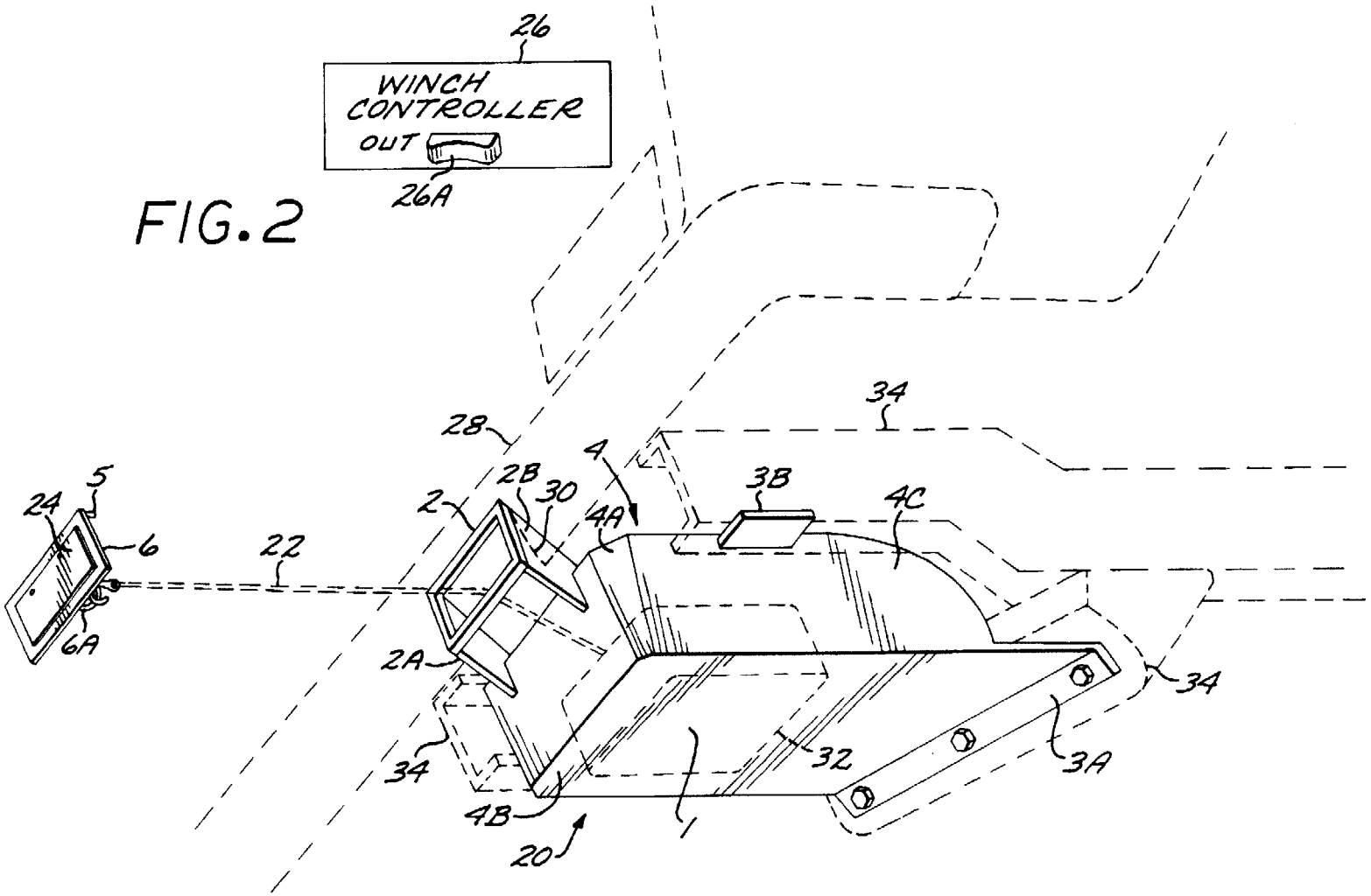
FIG. 2 is an isometric view of the skid plate/winch mount apparatus of FIG. 1, in an installed position on a vehicle.

The major component of the skid plate/winch mount 20 is the main body 4. It is installed by fastening the attachment points 3A, 3B, 3C of the main body 4 to the frame 34 of the vehicle, as illustrated in FIG. 2. This positions the mount 20 to the front underside of the engine compartment, providing road hazard protection to this location by the skid plate 4B comprising the main body 4. The main body 4 has an attached adapter plate receiver 2 that is to be located behind the front license plate 24 of the vehicle. A small cutout 30 must be removed from the vehicle bumper 28 to allow the winch cable 22 to pass through. The license plate 24 is then secured to the bumper 30 using an adapter plate 6 fastened to the rear of the license plate. The adapter plate 6 has an eyehole 6A that allows the winch cable 22 to hook to the back of the plate 6.

The main body 4 provides a winch mounting location 1 at the top of the skid plate 4B. A winch 32 (shown in phantom in FIG. 2) is mounted to the structure 20 at the mounting location. The winch cable 22 is passed through the cable guide 2.

Activation of the out button 26A on the winch controller 26 allows the adapter plate 6 to be pulled away from the vehicles front bumper 30, while the winch cable is paid out from the winch. The adapter plate 6 is then unhooked from the end of the winch cable and stowed during winching operation. After use of the winch is complete, the adapter plate 6 is refastened to the end of the winch cable, and the cable 22 is then drawn toward the winch, pulling the license plate 24 and the adapter plate 6 against the adapter plate receiver 2, fully concealing the winch from view. Guide pins 5 and tension on the winch cable 22 retain the license plate against the adapter plate receiver 2 during normal operation of the vehicle.

The main body 4 of the skid plate/winch mount 20 is fabricated of ¼" steel plate (other metals and thicknesses are being considered) that is welded together. The front panel 4A of the main body 4 is bent approximately 30 degrees at either end for a rounded appearance. The main body further includes first and second side panels 4C, 4D. The front and side panels are each secured to the skid plate 4B. The rear mounting point 3A of the main body 4 is angled down approximately 35 degrees to align it with the vehicle frame. The other two mounting points 3B, 3C are made of ¼"×2"×3" steel that are welded to the main body 4 of the mount 20. These mounting positions will be varied to accommodate other vehicle models.

The adapter plate receiver/cable guide 2 is first welded as a rectangle using 1" solid steel roundstock cut at 45 degree angles. The side gussets 2B, 2C, made of ½" steel plate, are then attached to the rectangular frame. Final assembly consists of welding the ½" steel gussets 2B, 2C (FIG. 1) to the front panel 4A of the main body 4.

The license adapter plate 6 is fabricated from ⅛" steel plate that is cut to match the size of the vehicle's license plate. Two ¼" pins 5 are welded to the upper corners of the license adapter plate. Flatstock, ⅛"×⅝×7", is then formed into a "U" shape and welded to the center of the adapter plate to form the eyehole 6A.

The skid plate/winch mount 20 has two primary functions, providing a secure location 1 to mount a vehicle winch hidden from view and protecting the front underside of the vehicle from damage by rocks or other road hazards. The secondary functions of the skid plate/winch mount 20 include the use of a cable guide 2 to prevent damage to the vehicle by the winch cable 22, protection of the winch from weather and damage by positioning it above the skid plate and below the vehicle's hood, and concealment of the winch to avoid theft. These functions are in significant contrast to current winch mounting procedures that leave the winch clearly visible and open to damage by road hazards offering no significant protection to the underside of the vehicle.

I claim:

1. A skid plate/winch mount for mounting a winch to a vehicle, comprising:

a main body structure comprising a skid plate and a plurality of attachment locations for mounting the skid plate/winch mount to a vehicle frame so as to position the mount to the front underside of the engine compartment of the vehicle, providing road hazard protection to this location by the skid plate comprising the main body, said main body structure further including a winch mounting location on a top surface of the skid plate for mounting thereto a winch, so that the winch is hidden from view from the exterior of the vehicle;

an adapter plate having a front surface and a rear surface, and a cable attachment fixture attached to the rear surface;

adapter plate receiver and cable guide structure attached to the main body structure, and adapted to fit an opening formed in the vehicle bumper such that the adapter plate receiver is positioned adjacent the vehicle bumper and the cable guide extends between the adapter plate receiver and the main body structure, the cable guide structure adapted to guide a winch cable between the winch mounted to the main body structure through an aperture in the adapter plate receiver;

wherein the adapter plate can be brought into a stowed position at the adapter plate receiver such that the adapter plate covers the aperture formed in the adapter plate receiver when the winch is not in use and the cable is withdrawn, and can be released from the winch cable by paying out cable from the winch to expose the attachment fixture.

2. The skid plate/winch mount of claim 1 wherein the front surface of the adapter plate is a mounting surface for mounting thereto a vehicle license plate.

3. The skid plate/winch mount of claim 1 wherein said main body includes a front panel, and said cable guide is attached to the front panel.

4. The skid plate/winch mount of claim 1 wherein the cable guide is adapted to prevent damage to the vehicle by the winch cable during operation of the winch.

5. The skid plate/winch mount of claim 1 wherein the winch mounting locations of the main body are adapted to position the winch above the skid plate and below the hood of the vehicle, thereby concealing the winch.

6. The skid plate/winch mount of claim 1 wherein said attachment fixture is an eyehole.

7. The skid plate/winch mount of claim 1 wherein the main body further includes a front panel and first and second side plates, each secured to the skid plate.

8. For mounting a winch including a winch cable to the frame of a vehicle including an engine compartment, a frame and a front bumper, a skid plate/winch mount apparatus comprising:

a main body structure comprising a skid plate and a plurality of attachment locations for mounting the apparatus to the vehicle frame so as to position the mount to the front underside of the engine compartment of the vehicle, providing road hazard protection to this location by the skid plate comprising the main body, said main body structure further including a winch mounting location on a top surface of the skid plate for mounting thereto a winch, so that the winch is hidden from view from the exterior of the vehicle;

an adapter plate having a front surface and a rear surface, and a cable attachment fixture attached to the rear surface;

adapter plate receiver and cable guide structure attached to the main body structure, and extending to an opening formed in the vehicle front bumper, the adapter plate receiver and cable guide structure adapted to guide a winch cable between the winch mounted to the main body structure and through the opening in the vehicle front bumper;

wherein the adapter plate is adapted to cover an aperture formed in the adapter plate receiver and cable guide structure when the adapter plate is brought into a stowed position at the adapter plate receiver when the winch is not in use and the cable is withdrawn, and the attachment fixture is adapted to be released from the winch cable by paying out cable from the winch to expose the attachment fixture.

9. The apparatus of claim 8 wherein the front surface of the adapter plate is a mounting surface for mounting thereto a vehicle license plate.

10. The apparatus of claim 8 wherein said main body includes a front panel, and said cable guide is attached to the front panel.

11. The apparatus of claim 8 wherein the adapter plate receiver and cable guide structure is adapted to prevent damage to the vehicle by the winch cable during operation of the winch.

12. The apparatus of claim 8 wherein the winch mounting locations of the main body are adapted to position the winch above the skid plate and below the hood of the vehicle, thereby concealing the winch.

13. The apparatus of claim 8 wherein said attachment fixture is an eyehole.

14. The apparatus of claim 8 wherein the main body further includes a front panel and first and second side plates, each secured to the skid plate.

15. A winch mount apparatus for mounting a winch to a vehicle, comprising:

a main body structure comprising at least one attachment location for mounting the apparatus to the vehicle frame, said main body structure further including a winch mounting location for mounting thereto a winch, so that the winch is hidden from view from the exterior of the vehicle;

an adapter plate having a front surface and a rear surface, and a cable attachment fixture attached to the rear surface;

adapter plate receiver and cable guide structure attached to the main body structure, and extending to an opening formed in a vehicle bumper, the adapter plate receiver and cable guide structure adapted to guide a winch cable between the winch mounted to the main body structure and through the opening in the vehicle bumper;

wherein the adapter plate is adapted to cover an aperture formed in the adapter plate receiver and cable guide structure when the adapter plate is brought into a stowed position at the adapter plate receiver when the winch is not in use and the cable is withdrawn, and the attachment fixture is adapted to be released from the winch cable when the winch is in use.

16. The mount apparatus of claim 15 wherein the front surface of the adapter plate is a mounting surface for mounting thereto a vehicle license plate.

17. The mount apparatus of claim 15 wherein said main body includes a front panel, and said cable guide is attached to the front panel.

18. The mount apparatus of claim 15 wherein the adapter plate receiver and cable guide structure is adapted to prevent damage to the vehicle by the winch cable during operation of the winch.

19. The mount apparatus of claim 15 wherein the winch mounting location of the main body is adapted to position the winch below the hood of the vehicle.

20. The apparatus of claim 15 wherein said attachment fixture is an eyehole.

* * * * *